US007445307B2

(12) United States Patent
Sato

(10) Patent No.: US 7,445,307 B2
(45) Date of Patent: Nov. 4, 2008

(54) DROPLET JETTING APPARATUS AND DISPLAY DEVICE MANUFACTURING METHOD

(75) Inventor: Tsuyoshi Sato, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 411 days.

(21) Appl. No.: 11/184,915

(22) Filed: Jul. 20, 2005

(65) Prior Publication Data

US 2006/0017765 A1 Jan. 26, 2006

(30) Foreign Application Priority Data

Jul. 20, 2004 (JP) ..... 2004-211747

(51) Int. Cl.
*B41J 29/393* (2006.01)

(52) U.S. Cl. ..... 347/19; 347/68; 347/70

(58) Field of Classification Search ..... 347/19
See application file for complete search history.

(56) References Cited

U.S. PATENT DOCUMENTS 6,729,184 B2 * 5/2004 Tsukada et al. ..... 73/290 V
7,070,346 B2 * 7/2006 Fujimori ..... 400/76
7,267,420 B2 * 9/2007 Yagi ..... 347/19

FOREIGN PATENT DOCUMENTS

JP 11-334102 12/1999
JP 2002-221617 8/2002

OTHER PUBLICATIONS

Patent Abstracts of Japan, JP 2002-221617, Aug. 9, 2002.
U.S. Appl. No. 11/535,319, filed Sep. 26, 2006, Ooshiro, et al.

* cited by examiner

*Primary Examiner*—Matthew Luu
*Assistant Examiner*—Brian J Goldberg
(74) *Attorney, Agent, or Firm*—Oblon, Spivak, McClelland, Maier & Neustadt, P.C.

(57) ABSTRACT

A droplet jetting apparatus includes an actuator becoming deformed by a voltage application; an elastic body adhered to the actuator and becoming deformed in response to a deformation of the actuator; an ink chamber filled with ink, jetting a droplet of the ink in response to a deformation of the elastic body; a voltage information acquirer acquiring a voltage information of the actuator; and a sense/decider sensing at least any of an abnormality in the ink chamber, a failure of the actuator, and a defective adhesion between the actuator and the elastic body based on the voltage information, and deciding whether or not the ink is being jetted normally.

9 Claims, 8 Drawing Sheets

DROPLET JETTING APPARATUS AND DISPLAY DEVICE MANUFACTURING METHOD

CROSS REFERENCE OF THE RELATED APPLICATION

This application is based upon and claims the benefit of priority from the priority Japanese Patent Application No.2004-211747, filed on Jul. 20, 2004, the entire contents of which are incorporated herein by reference.

BACKGROUND OF THE INVENTION

1. Field of the Invention

The present invention relates to a droplet jetting apparatus for jetting an ink droplet onto an object, and a display device manufacturing method of forming a pixel of a display device by jetting the ink droplet.

2. Discussion of the Background

In case the display device such as an organic EL (Electro Luminescence) display, or the like is manufactured, the ink serving as the material of the luminous layer is jetted and then the pixel is formed by this ink.

As an example of such ink applying method, the method of generating a minute droplet of the ink and then jetting this droplet onto the object such as the substrate, or the like (referred appropriately to as an "I/J method" hereinafter) may be listed (see Patent Application Publication (KOKAI) 2002-221617, for example).

However, when there is some trouble in the application head that jets the ink, in some cases an adequate amount of ink cannot be jetted. According to an extent of such trouble, sometimes the ink cannot be jetted at all.

For instance, as shown in FIG. 1, when there is some trouble in a nozzle E of an application head 115 or an ink chamber corresponding to the nozzle E, a stripe irregularity (luminance nonuniformity) 91 is generated on a substrate 109 owing to the non-jetting of the ink or the lack of ink to be jetted, which is caused due to such trouble (these are referred appropriately to as a "jet malfunction" hereinafter). This results in a marked reduction in the quality of the organic EL display, or the like.

Also, when the Ink jet is carried out, it is checked in advance whether or not the jet malfunction is being generated. In this event, sometimes the jet malfunction is generated after the ink jet is actually carried out. If such malfunction cannot be sensed at once, it is continued to manufacture the substrate, or the like, on which the stripe irregularity is generated as described above. As a result, no non-defective product can be manufactured after the generation of the jet malfunction.

However, it is difficult to sense immediately the jet malfunction without fail.

SUMMARY OF THE INVENTION

It is an object of the present Invention to provide a droplet jetting apparatus and a display device manufacturing method capable of sensing immediately a jet malfunction of ink without fail.

A first aspect according to the embodiment of the present invention provides a droplet jetting apparatus, which includes an actuator becoming deformed by a voltage application, an elastic body adhered to the actuator and becoming deformed in response to a deformation of the actuator, an ink chamber filled with ink, jetting a droplet of the ink in response to a deformation of the elastic body, a voltage information acquirer acquiring a voltage information of the actuator, and a sense/decider sensing at least any of an abnormality in the ink chamber, a failure of the actuator, and a defective adhesion between the actuator and the elastic body based on the voltage information, and deciding whether or not the ink is being jetted normally.

A second aspect according to the embodiment of the present invention provides a display device manufacturing method, which includes forming a pixel of a display device by a droplet of ink jetted by using an actuator becoming deformed by a voltage application, an elastic body adhered to the actuator and becoming deformed in response to a deformation of the actuator, and the ink chamber filled with ink, jetting a droplet of the ink in response to a deformation of the elastic body, acquiring a voltage information of the actuator, and sensing at least any of an abnormality in the ink chamber, a failure of the actuator, and a defective adhesion between the actuator and the elastic body based on the voltage information, and deciding whether or not the ink is being jetted normally.

DETAILED DESCRIPTION OF THE INVENTION

Figure 1:
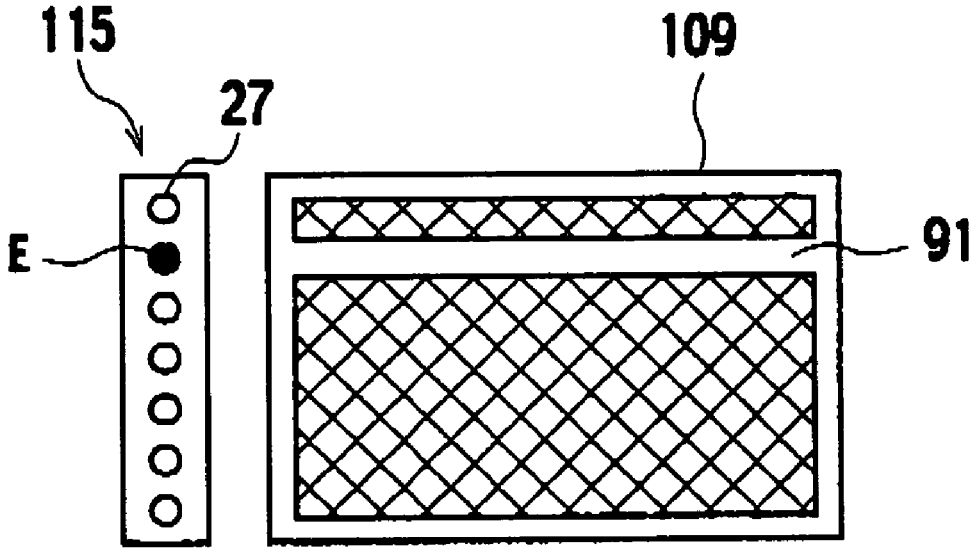
FIG. 1 is a view explaining a stripe irregularity generated on a substrate.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Figure 2:
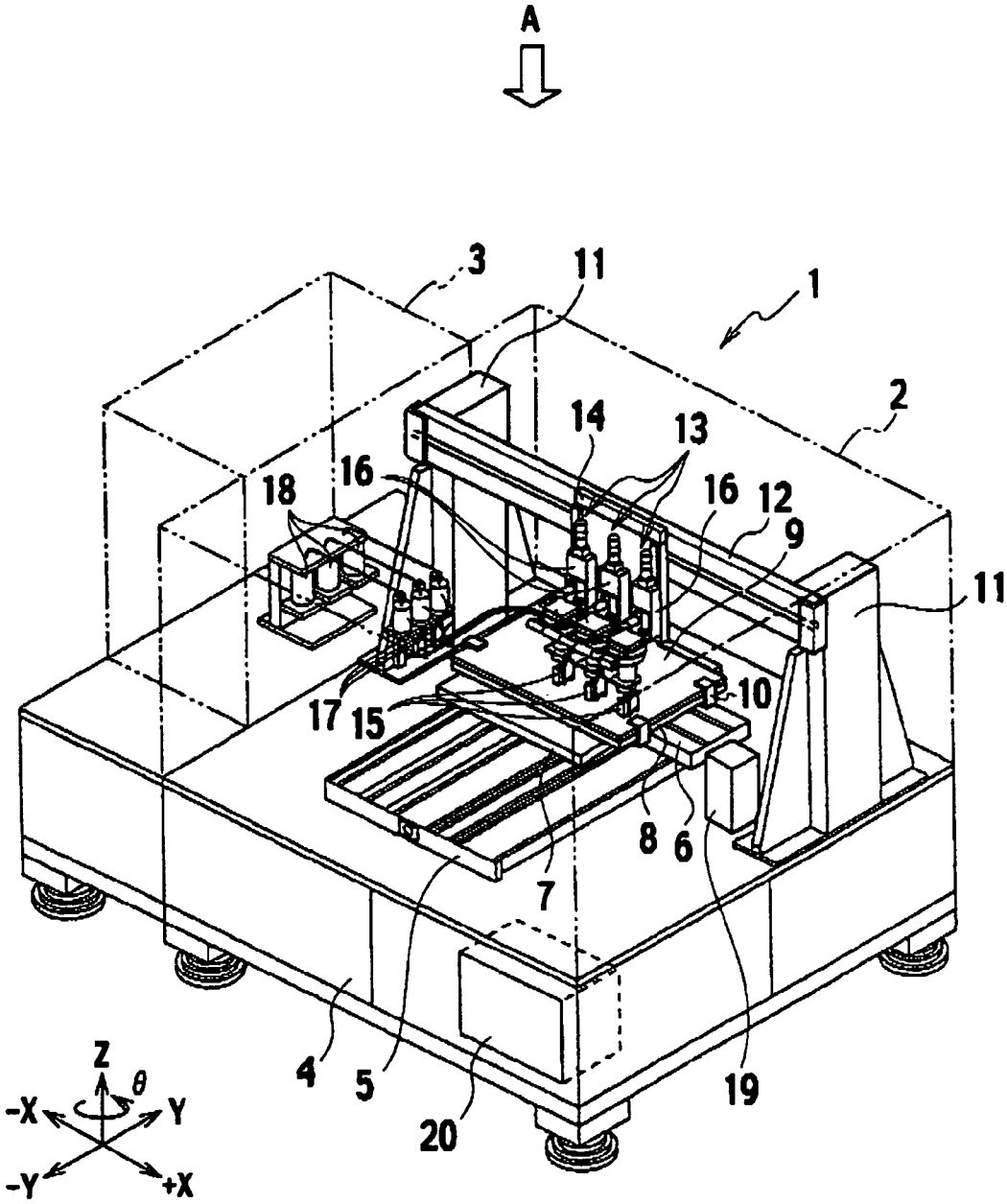
FIG. 2 is a perspective view showing a droplet jetting apparatus according to an embodiment of the present invention.

As shown in FIG. 2, a droplet jetting apparatus 1 according to an embodiment of the present invention is used to manufacture a display device such as the organic EL display, or the like. The droplet jetting apparatus 1 includes an ink application box 2 and an ink supply box 3. The ink application box 2 and the ink supply box 3 are arranged adjacently to each other and fixed to an upper surface of a platform 4.

A Y-axis direction slide plate 5, a Y-axis direction movable table 6, a X-axis direction movable table 7, and a substrate holding table 8 are stacked in the inside of the ink application box 2.

The Y-axis direction slide plate 5 is fixed to the platform 4. At least one groove or more is provided to a surface of the Y-axis direction slide plate 5 along the Y-axis direction (refer to FIG. 2). The Y-axis direction movable table 6 has a projection mechanism (not shown) that is used to move along the groove formed on the Y-axis direction slide plate 5. The projection mechanism is fitted into the groove of the Y-axis direction slide plate 5. As a result, it is possible for the Y-axis direction movable table 6 to move in the Y-axis direction.

Also, at least one groove or more is provided to a surface of the Y-axis direction movable table 6 along the X-axis direction (refer to FIG. 2). The X-axis direction movable table 7 has a projection mechanism (not shown) that is used to move along the groove formed on the Y-axis direction movable table 6. The projection mechanism is fitted into the groove of the Y-axis direction movable table 6. As a result, it is possible for the X-axis direction movable table 7 to move in the X-axis direction.

Accordingly, the Y-axis direction movable table 6 slides in ± the Y-axis direction, and the X-axis direction movable table 7 slides in ± the X-axis direction.

The substrate holding table 8 has a substrate sucking mechanism or substrate clamping mechanism 10. A substrate 9 is tightly held/fixed onto the substrate holding table 8 by the substrate sucking mechanism or substrate clamping mechanism 10. Here, the substrate sucking mechanism consists of a rubber suction cup, a suction pump, or the like, for example, and the substrate clamping mechanism 10 consists of a clamping tool, or the like, for example.

In addition, as a correcting mechanism for maintaining the ink application direction (Y direction) in parallel with the moving direction of the Y-axis direction movable table 6 and a correcting mechanism for maintaining the ink application direction in orthogonal with the moving direction of the X-axis direction movable table 7, a θ direction correcting mechanism is provided to the Y-axis direction movable table 6 and the X-axis direction movable table 7 respectively.

The θ direction correcting mechanism in the present embodiment is composed of a rotary disk having a flat surface. The rotary disk is provided to lower surfaces of the Y-axis direction movable table 6 and the X-axis direction movable table 7 or provided between them. Accordingly, the θ direction correcting mechanism makes the turn of the Y-axis direction movable table 6 or the X-axis direction movable table 7 in the 9 direction possible, and can maintain above parallelism or orthogonal.

Further, a set of columns 11 are provided upright in the interior of the ink application box 2. The set of columns 11 are provided on both sides, which put the Y-axis direction slide plate 5 therebetween, in the direction that is perpendicular to the groove formed on the Y-axis direction slide plate 5.

An X-axis direction slide plate 12 is put between the set of columns 11. Application head units 13 for jetting the ink to a surface of the substrate 9 are provided to the X-axis direction slide plate 12 slidable in the X-axis direction by an application head unit clamping member 14. Because that X-axis direction slide plate 12 is provided, the application head units 13 can be moved in the direction that is perpendicular to the ink pattern application direction.

An application head 15 is provided to a top end of the application head unit 13. The application head 15 receives a supply of ink from an ink tank 17 via a piping. The ink tank 17 is connected to an ink supply tank 18 and is put in a state that such tank can always accept a supply of ink from the ink supply tank 18.

A vertically movable mechanism 16 that can vertically move in the direction perpendicular to the surface of the substrate 9 is provided to the application head unit 13. As a result, a distance between the application head 15 and the substrate 9 can be set to a desired interval.

In addition to these mechanisms, a head maintenance unit 19 for cleaning the ink clogging of the nozzle of the application head 15 is provided in the interior of the ink application box 2. The head maintenance unit 19 is arranged in the position that is separated from the substrate 9 on a prolonged line along the sliding direction of the X-axis direction slide plate 12. The head maintenance unit 19 can automatically clean the clogging of the nozzle hole when the application head unit 13 is moved to an end of the X-axis direction slide plate 12 to position just over the head maintenance unit 19.

In this case, drive control and correction control of the Y-axis direction movable table 6, the X-axis direction movable table 7, the X-axis direction slide plate 12, the vertically movable mechanism 16, etc., described above, are carried out by a control unit 20. The control unit 20 is provided in the inside of the platform 4. Also, the control unit 20 controls an amount of ink jetted from the application head 15.

Figure 3:
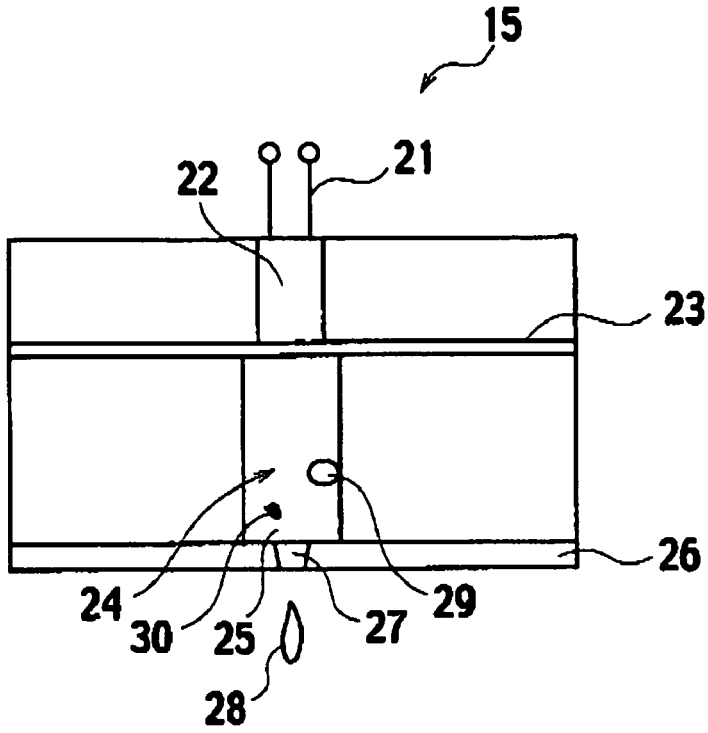
FIG. 3 is a schematic view showing an application head provided to the droplet jetting apparatus.

As shown in FIG. 3, the application head 15 has electrodes 21, actuators (piezoelectric elements) 22, a diaphragm (elastic body) 23, ink chambers 24, an orifice plate 26, and nozzles 27. In this case, for purposes of simplifying the illustration, merely one actuator 22, one ink chamber 24, and one nozzle 27 are depicted in FIG. 3 respectively.

Figure 4:
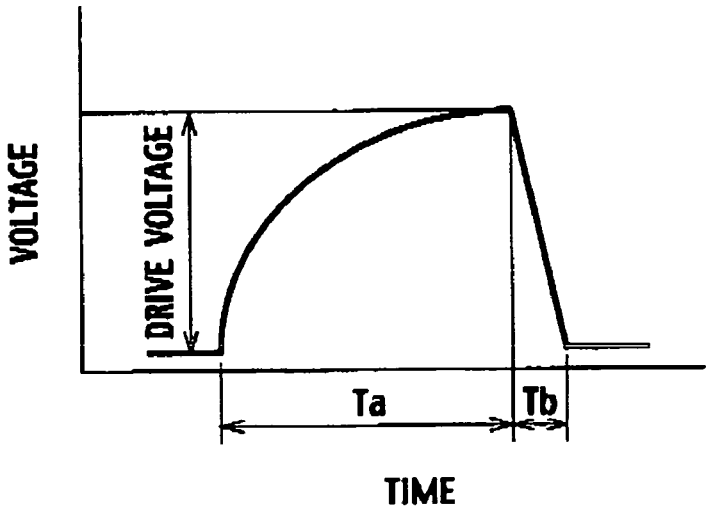
FIG. 4 is a view explaining the principle of the application head provided to the droplet jetting apparatus.

The actuator 22 is adhered to the diaphragm 23. When a voltage is applied to the actuator 22 via the electrodes 21, the actuator 22 contracts to move the diaphragm 23 upwardly (interval Ta in FIG. 4).

When the diaphragm 23 is moved, a volume of the ink chamber 24 is increased and also a pressure of an interior of the ink chamber 24 Is decreased. Thus, ink 25 is supplemented to the inside of the ink chamber 24 from a passage (not shown).

Then, when the applied voltage goes back to zero (interval Tb in FIG. 4), the diaphragm 23 returns to its original state and also the ink chamber 24 is pressed. Thus, a droplet 28 of the ink 25 is jetted from the nozzle 27.

Here, when bubbles 29, for example, are present in the ink chamber 24, a force applied to the actuator 22 and the diaphragm 23 is consumed to compress the bubbles 29. Thus, sometimes an adequate amount of droplet 28 cannot be jetted (the lack of jetted amount) or the droplet 28 cannot be jetted at all (non-jetting).

Also, when the bubble 29, a foreign substance 30 such as a dust, or the like are present in vicinity to the nozzle 27 in the ink chamber 24, the nozzle 21 is blocked by such substance and thus the lack of jetted amount of ink or the non-jetting of ink is caused.

Also, when the actuator 22 is not brought into tight contact with the diaphragm 23, the force cannot be appropriately transmitted to the diaphragm 23 and thus the diaphragm 23 cannot appropriately become deformed. Thus, the lack of jetted amount of ink or the non-jetting of ink is caused.

Also, when the actuator 22 is broken down (disconnected), the diaphragm 23 cannot become deformed. Thus, the non-jetting of ink is caused.

In the following explanation, the lack of jetted amount of ink and the non-jetting of ink are also defined appropriately as the "jet malfunction".

Figure 5:
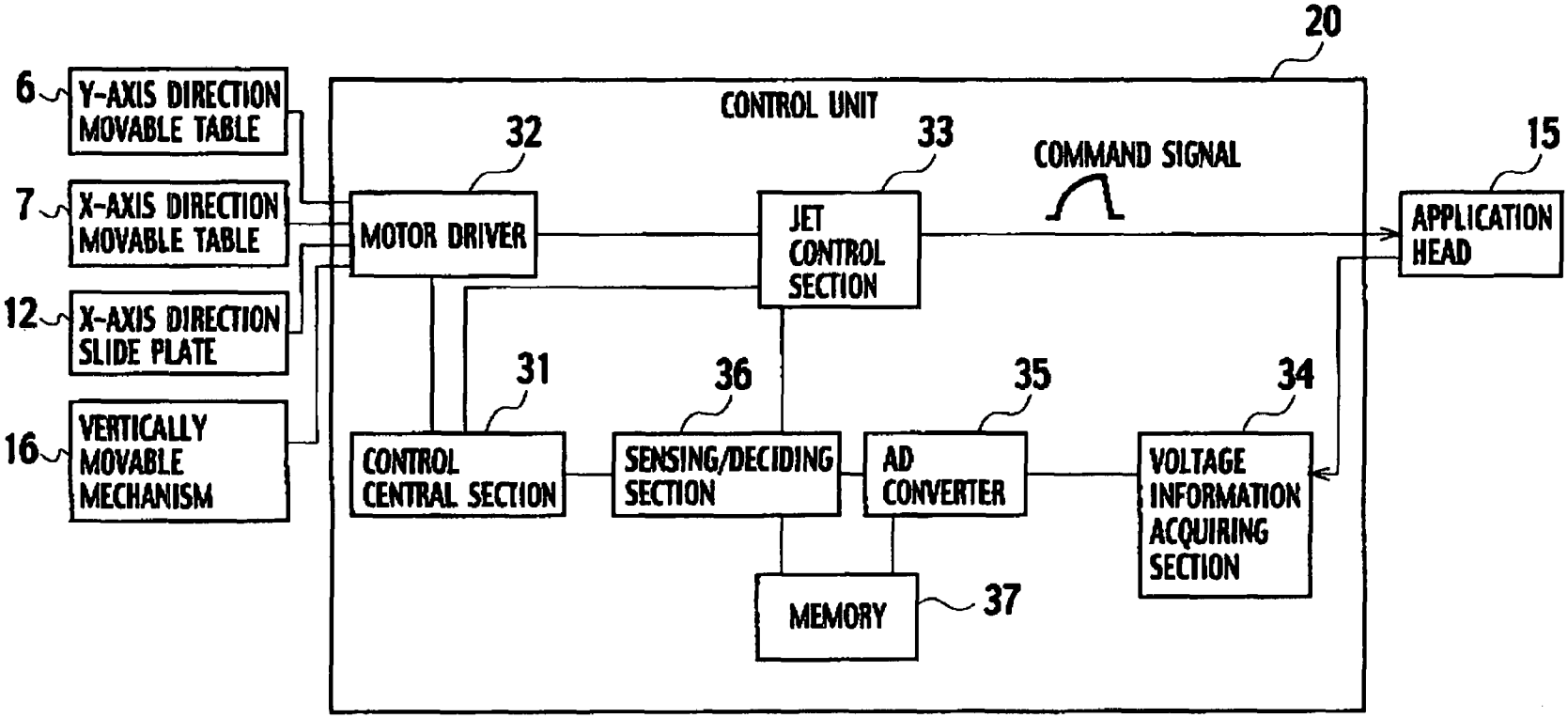
FIG. 5 is a block diagram showing a configuration of a control unit provided to the droplet jetting apparatus.

As shown in FIG. 5, the control unit 20 is constructed by a control central section 31, a motor driver 32, a jet control section 33, a voltage information acquiring section 34, an AD converter 35, a sensing/deciding section 36, and a memory 37.

The control central section 31 transmits a stage position signal indicating the position of the substrate 9, etc., a jet enabling signal for causing the application head 15 to jet the ink, an application pattern signal indicating an arrangement of pixels of the luminous layer formed on the substrate 9 in FIG. 2, and the like to the let control section 33.

The motor driver 32 control the Y-axis direction movable table 6, the X-axis direction movable table 7, the X-axis direction slide plate 12, the vertically movable mechanism 16, etc. under control of the control central section 31, and then transmits these encoder signals to the jet control section 33.

The jet control section 33 generates a command signal having a command waveform in FIG. 5 from above respective signals, and then transmits the generated command signal to the application head 15. The application head 15 jets the ink based on the command signal.

The actuator 22 in FIG. 3 converts the electric signal into the mechanical energy in a sense. Therefore, if a voltage waveform of the actuator 22 is measured, a condition of the portion located in front of the actuator 22, i.e., a condition of the mechanical load of the diaphragm 23 can be known and accordingly a condition of an inside of the ink chamber 24 can be known.

The voltage information acquiring section 34 is connected to the electrodes 21 in FIG. 3. This voltage information acquiring section 34 acquires voltage information containing the voltage value and the voltage waveform of the actuator 22. Here, the voltage information acquiring section 34 functions as a voltage information acquirer.

Normally a voltage of several tens V to several hundreds V is applied to the voltage information acquiring section 34. For this reason, when accepts the voltage information, the voltage information acquiring section 34 lowers the voltage to a level (e.g., 10 V or less) at which handling of the voltage is made easy.

Here, unless the voltage information acquiring section 34 lowers the voltage, such a configuration may be employed that only the waveform whose voltage value is 10 V or less should be measured.

Also, the voltage information acquiring section 34 has an edge sensing circuit, for example.

Figure 6:
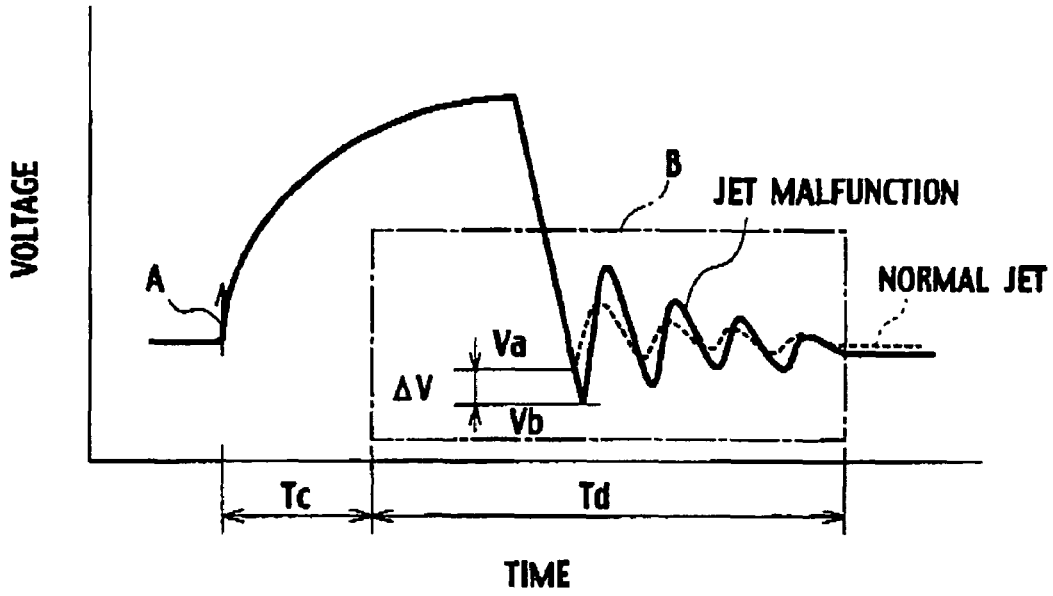
FIG. 6 is a view explaining an example of a jet malfunction sensing/deciding method.

As shown In FIG. 6, the voltage information acquiring section 34 senses a rising point A of the waveform and then acquires the voltage signal within a set voltage range, in which the voltage waveform in a set time period Tc and an information acquiring time period Td can be observed after the command waveform has begun to fall down, i.e., within a range B in FIG. 6.

The AD converter 35 converts the voltage information acquired by the voltage information acquiring section 34 into a digital form, and then stores sequentially the resultant information in the memory 37.

Also, the memory 37 stores previously not only the foregoing information but also the voltage information required to jet the ink normally, e.g., the voltage information when the ink was jetted normally (referred appropriately to as "normal time voltage information" hereinafter).

Here, the voltage information contains voltage waveform information (successive voltage value information) that is stored in the form of the representative per unit time, or the like.

The sensing/deciding section 36 reads the voltage information acquired by the voltage information acquiring section 34 and the normal time voltage information from the memory 37, and then compares both voltage information mutually. Thus, the sensing/deciding section 36 senses at least any one of the abnormality in the ink chamber 24, i.e., the presence of the bubble 29 or the foreign substance 30, the defective adhesion between the actuator 22 and the diaphragm 23, and the failure of the actuator 22, and then decides whether or not the jet malfunction is generated. Here, the sensing/deciding section 36 functions as a sense/decider.

The sensing/deciding section 36, when decides that the jet malfunction is being generated, transmits immediately a malfunction deciding signal indicating that effect to the control central section 31.

The control central section 31, when receives the malfunction deciding signal transmitted from the sensing/deciding section 36, transmits a jet stop signal to the jet control section 33. The jet control section 33, when receives the jet stop signal transmitted from the control central section 31, stops the transmission of the command signal (i.e., voltage application; application of a voltage) to the application head 15 to stop an operation of the application head 15. Here, the jet control section 33 functions as a voltage application stopper.

Next, details of the process in the sensing/deciding section 36 will be explained hereunder.

In the case where the bubble 29 exists in the ink chamber 24, compliance of the mechanical load of the actuator 22 is increased and thus the voltage waveform is oscillatory, as shown in FIG. 6.

The sensing/deciding section 36 reads the voltage waveform in the normal jetting operation (normal time voltage waveform) contained in the normal time voltage information stored in the memory 37, and sets a lower limit value of the normal time voltage waveform as Va.

Then, the sensing/deciding section 36 senses a lower limit value Vb of the voltage information each time while causing the voltage information acquiring section 34 to acquire successively the voltage information (voltage waveform), and then calculates a difference $\Delta V(=|Va|-|Vb|)$ between the above lower limit value Va and this lower limit value Vb.

Then, the sensing/deciding section 36 decides whether or not the jet malfunction is being generated, based on the calculated $\Delta V$. In other words, the sensing/deciding section 36 compares a voltage difference threshold value $\Delta Vdet$ detected previously with $\Delta V$, and decides that the jet malfunction is being generated when $\Delta V$ is larger than $\Delta Vdet$. The voltage difference threshold value $\Delta Vdet$ is stored in advance in the memory 37.

Figure 7:
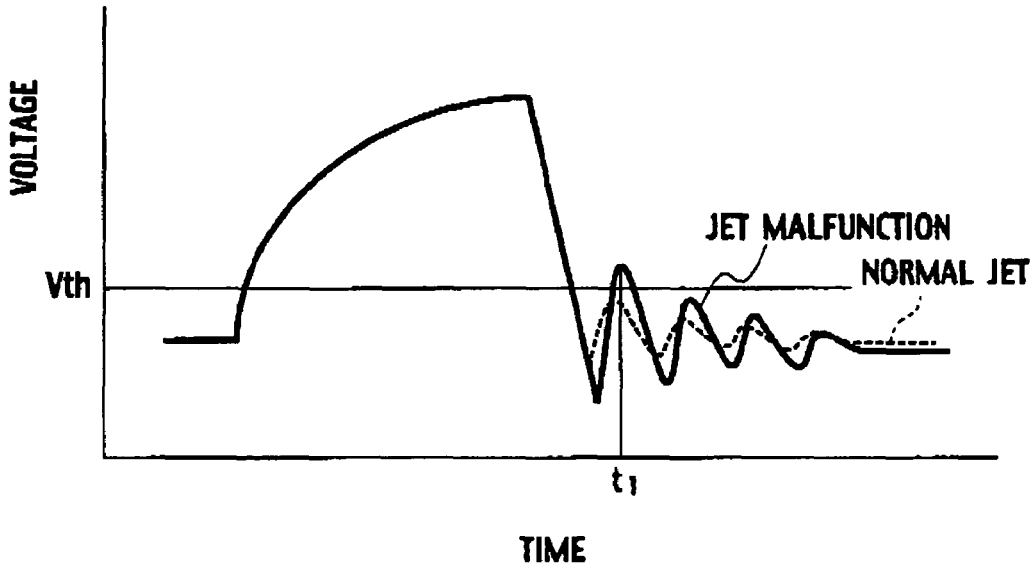
FIG. 7 is a view explaining another example of the jet malfunction sensing/deciding method.

Also, as shown in FIG. 7, such a configuration may be employed that, when the voltage value at a certain point of time t1 after the command waveform has begun to fall down is larger than a voltage threshold value Vth detected previously, the sensing/deciding section 36 decides that the jet malfunction is being generated. The voltage threshold value Vth is stored previously in the memory 37.

Also, such a configuration may be employed that the sensing/deciding section 36 decides whether or not the jet malfunction is being generated, based on a decay rate of a residual oscillation after the jetting.

In the above processing, the sensing of the bubble 29 is carried out under the assumption that a time is set on the X axis and a voltage is set on the Y axis. But such sensing of the bubble 29 is not limited to this method. The bubble 29 can be sensed by another processing method. Details thereof will be explained hereunder.

Figure 8:
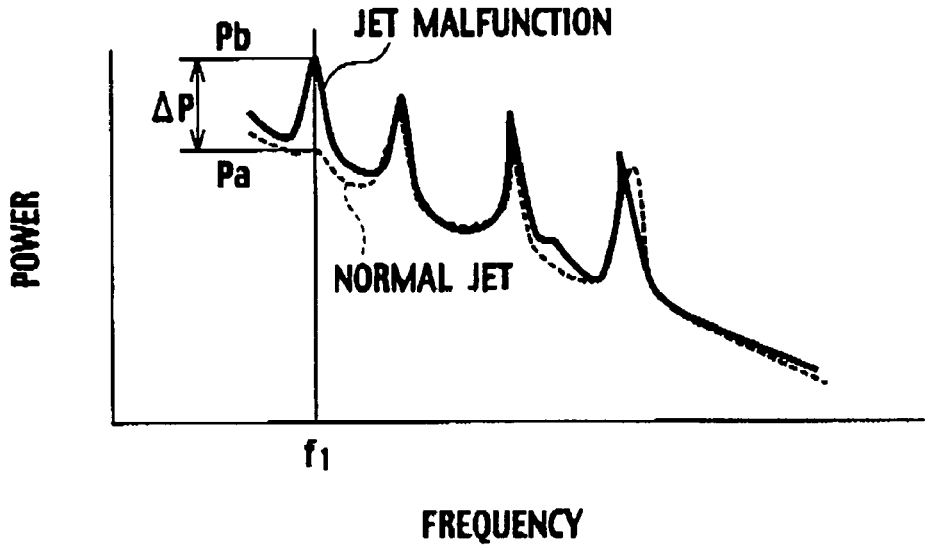
FIG. 8 is a view explaining another example of the jet malfunction sensing/deciding method.

First, the sensing/deciding section 36 reads the voltage waveform in the normal jetting operation (a set of the voltage values collected successively at a predetermined sampling time) contained in the normal time voltage information stored in the memory 37, and then calculates a power spectrum shown in FIG. 8 by applying the Fourier transform to the voltage waveform.

In this case, the lowest natural frequency out of several natural frequencies of the system that consists of the application head 15 and the ink 25 is observed herein.

Then, the sensing/deciding section 36 calculates a peak value Pb each time by applying the Fourier transform to the voltage information while causing the voltage information acquiring section 34 to acquire successively the voltage information (voltage waveform), and then calculates a difference $\Delta P((=|Pb|-|Pa|)$ between this peak value Pb and a power value Pa in the normal jetting operation at a frequency f1.

Then, the sensing/deciding section 36 decides whether or not the jet malfunction is being generated, based on the calculated $\Delta P$. In other words, the sensing/deciding section 36 compares a power difference threshold value $\Delta Pdet$ detected previously with $\Delta P$, and decides that the jet malfunction is being generated when $\Delta P$ is larger than $\Delta Pdet$. The power difference threshold value a $\Delta Pdet$ is stored in advance in the memory 37.

Figure 9:
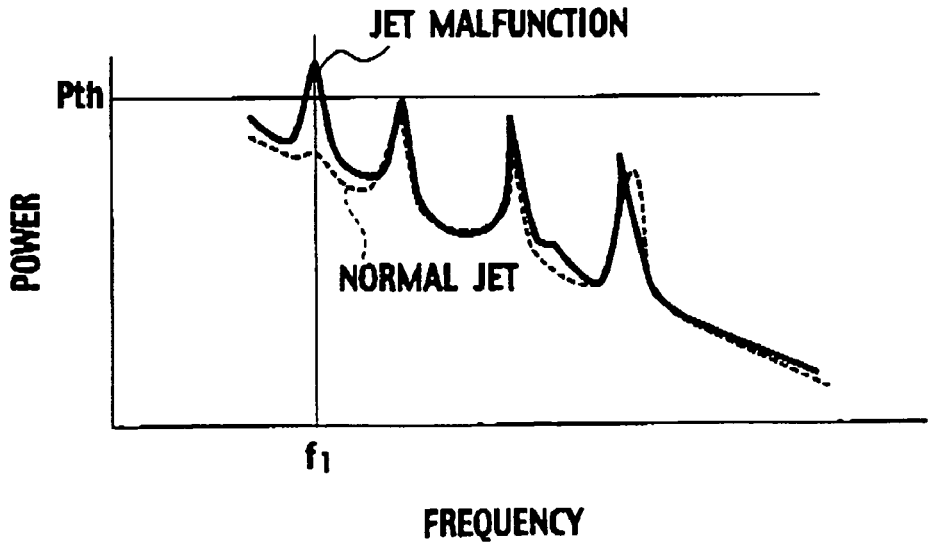
FIG. 9 is a view explaining still another example of the jet malfunction sensing/deciding method.

Also, as shown in FIG. 9, after a power threshold value Pth at a certain frequency f1 is calculated previously, such a configuration may be employed that, when a power value at a certain frequency f1 is larger than the power threshold value Pth, the sensing/deciding section 36 decides that the jet malfunction is being generated. The power threshold value Pth is stored in advance in the memory 37.

Figure 10:
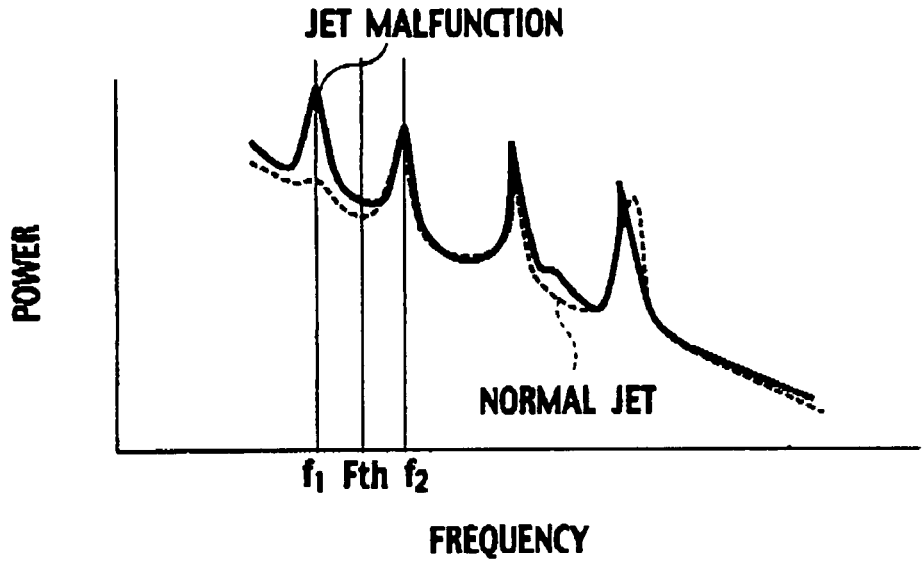
FIG. 10 is a view explaining yet still another example of the jet malfunction sensing/deciding method.

Also, as shown in FIG. 10, after a frequency threshold value Fth is calculated previously, such a configuration may be employed that, when a frequency f1 of the peak of the power value is smaller than the frequency threshold value Fth, the sensing/deciding section 36 decides that the jet malfunction is being generated. In this case, f2 in FIG. 10 denotes a frequency of the power peak in the normal jetting operation. The frequency threshold value Fth is stored in advance in the memory 37.

Figure 11:
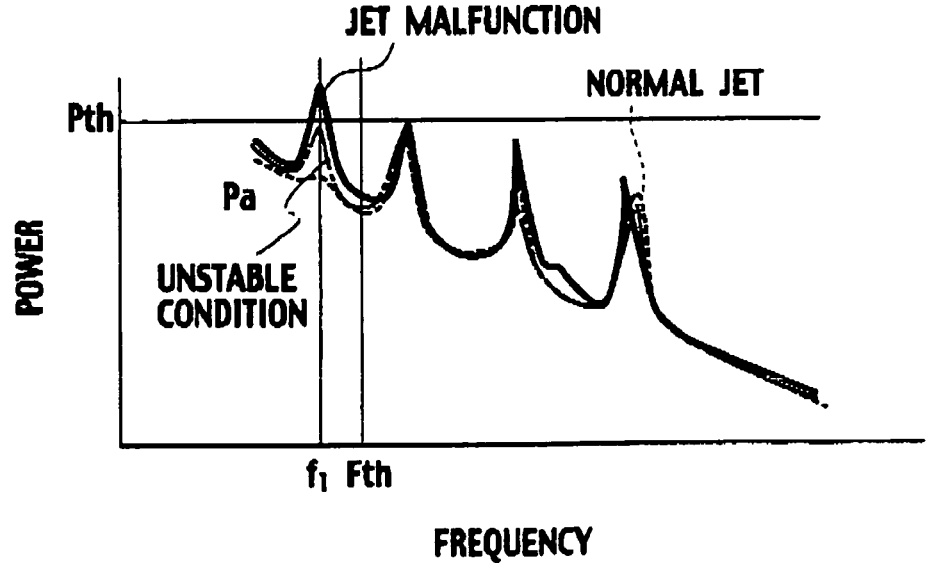
FIG. 11 is a view explaining a further example of the jet malfunction sensing/deciding method.

Also, as shown In FIG. 11, such a configuration may be employed that, when the peak value of the power is smaller than the power threshold value Pth and is larger than the power value in the normal jetting operation at a frequency f1 of this peak, and the frequency f1 is smaller than the frequency threshold value Fth, the sensing/deciding section 36 decides that the jet malfunction is not generated yet but the jetting operation is in an unstable condition having such a possibility that the jet malfunction is generated if the jet is continued, and then informs the user, or the like of this effect.

When the bubble 29 is extremely large, the above frequency becomes small but the peak itself is not generated. Therefore, the sensing/deciding section 36 senses the bubble 29 by sensing that condition.

Next, details of the processing in the case where the actuator 22 and the diaphragm 23 in FIG. 3 are not tightly adhered, i.e., the case where the defective adhesion is generated will be explained hereunder.

Figure 12:
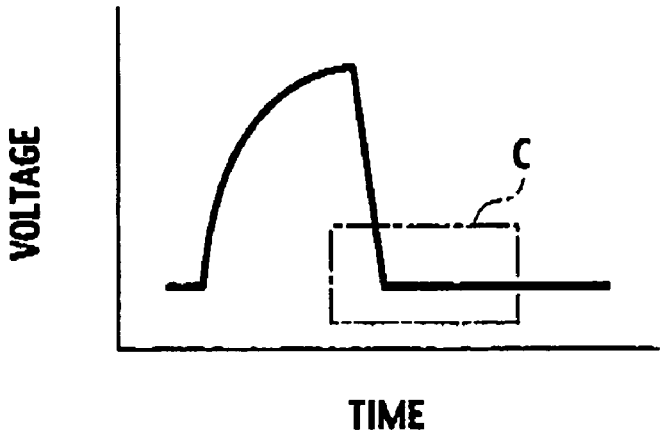
FIG. 12 is a view explaining an example of a voltage waveform in the time of jet malfunction.

In this case, because the diaphragm 23 cannot become deformed appropriately, the voltage waveform is given as shown in a range C in FIG. 12. Therefore, the above defective adhesion can be sensed by measuring the waveform in this range C.

Next, details of the processing in the case where the actuator 22 is broken down will be explained hereunder.

In this case, because the voltage is not applied, the voltage waveform having the curve, or the like, as mentioned above, is not generated and, as shown in FIG. 13, only a rectangular waveform of the signal being transmitted from the jet control section 33 in FIG. 5 to the electrodes 21 in FIG. 5 is sensed.

Figure 13:
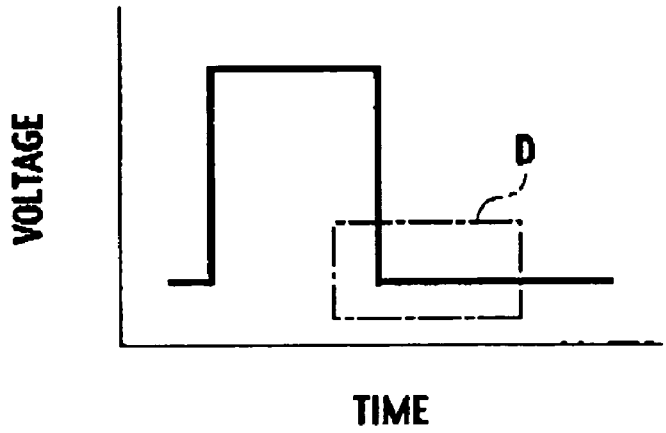
FIG. 13 is a view explaining another example of the voltage waveform In the time of jet malfunction.

Accordingly, the failure of the actuator 22 can be sensed by measuring the waveform in a range D in FIG. 13.

Next, an example of the pixel formation by the above droplet jetting apparatus 1 will be explained hereunder.

The ITOs (Indium Tin Oxides) as the transparent pixel electrode are patterned on the substrate 9 (FIG. 2). A partition is provided between these ITOs respectively, and an opening portion is formed by the partition.

First, the ink droplet 28 (FIG. 3) is applied onto the above opening portion by the application head 15 (FIG. 2 and FIG. 3).

Here, the ink 25 contains the hole injecting/transporting material such as polythiophene derivative, or the like. This hole injecting/transporting material is used to inject the hole into the luminous layer described later from the anode side and transport the hole.

After the ink 25 containing the above hole injecting/transporting material is applied, a removing a solvent of the ink 25 and an annealing in the nitrogen atmosphere, or the like is carried out and thus a hole injecting/transporting layer is formed.

Then, the ink droplet 28 containing the luminous material is applied on the hole injecting/transporting layer by the application head 15.

After the ink containing the above luminous material is applied, a removing a solvent of the ink 25 and an annealing in the nitrogen atmosphere, or the like is carried out and thus a luminous layer is formed.

Then, a cathode is formed by depositing or sputtering Ca, Mg, Ag, Al, Li, or the like by using another equipment. Then, a sealing layer is formed with an epoxy resin, or the like. Thus, the pixel formation is completed.

Also, a display device manufacturing method of sensing/deciding of the above jet malfunction is contained in a scope of the present invention.

As explained as above, according to the embodiment of the present invention, the voltage information of the actuator 22 while the ink jetting operation is executed is acquired, and then at least any one of the abnormality in the ink chamber 24, the failure of the actuator 22, and the defective adhesion between the actuator 22 and the diaphragm 23 is sensed based on the voltage information. Therefore, the jet malfunction of ink can be sensed immediately without fail.

Further, when the jet malfunction of the ink is generated, the operation of the application head 15 is stopped immediately after such jet malfunction is sensed. Therefore, it can be prevented that it is continued to produce the substrate on which the stripe irregularity is generated, etc. in massive quantities, and also productivity of the substrate, and the like can be improved.

Also, even though the substrate, and the like employed in the organic EL display are increased in size and accordingly a frequency of occurrence of the stripe irregularity on one substrate, etc. is increased, it can be prevented that it is continued to produce the substrate on which the stripe irregularity is generated, etc. In massive quantities, and also productivity of the substrate, and the like can be improved.

Various modifications will become possible for those skilled in the art after receiving the teachings of the present disclosure without departing from the scope thereof.

What is claimed is:

1. A droplet jetting apparatus, comprising:

an actuator becoming deformed by a command waveform application;

an elastic body adhered to the actuator and becoming deformed in response to a deformation of the actuator;

an ink chamber filled with ink, jetting a droplet of the ink in response to a deformation of the elastic body;

a voltage information acquirer acquiring a voltage waveform of the actuator just after the command waveform has begun to fall down; and a sense/decider sensing at least any of an abnormality in the ink chamber, a failure of the actuator, and a defective adhesion between the actuator and the elastic body based on the acquired voltage waveform, and deciding whether or not the ink is being jetted normally.

2. The droplet jetting apparatus according to claim 1, further comprising:

a memory storing previously a normal time voltage waveform of the actuator indicating that the ink is being jetted normally; and wherein the sense/decider compares the voltage waveform with the normal time voltage waveform, senses at least any of the abnormality in the ink chamber, the failure of the actuator, and the defective adhesion between the actuator and the elastic body, and decides whether or not the ink is being jetted normally.

3. The droplet jetting apparatus according to claim 1, further comprising:

a voltage application stopper stopping the command waveform application to the actuator when it is decided that the ink is not being jetted normally.

4. The droplet jetting apparatus according to claim 1, further comprising:

a memory storing previously a normal time voltage waveform of the actuator indicating that the ink is being jetted normally; and wherein the sense/decider calculates a lower limit value of the normal time voltage waveform and a lower limit value of the voltage waveform, calculates a difference between the lower limit value of the normal time voltage waveform and the lower limit value of the voltage waveform, senses at least any of the abnormality in the ink chamber, the failure of the actuator, and the defective adhesion between the actuator and the elastic body based on the difference, and decides whether or not the ink is being jetted normally.

5. The droplet jetting apparatus according to claim 1, further comprising:

a memory storing previously a normal time voltage waveform of the actuator indicating that the ink is being jetted normally; and wherein the sense/decider calculates a power spectrum by applying a Fourier transform to the normal time voltage waveform, calculates a peak value by applying the Fourier transform to the voltage waveform, calculates a power value at a frequency of the peak value from the power spectrum, calculates a difference between the peak value and the power value, senses at least any of the abnormality in the ink chamber, the failure of the actuator, and the defective adhesion between the actuator and the elastic body based on the difference, and decides whether or not the ink is being jetted normally.

6. The droplet jetting apparatus according to claim 1, wherein the voltage information acquirer acquires the voltage waveform when the ink chamber is jetting the droplet.

7. The droplet jetting apparatus according to claim 1, wherein the voltage information acquirer acquires the voltage waveform which is a residual oscillation waveform of the actuator.

8. The droplet jetting apparatus according to claim 1, wherein the sense/decider applies a Fourier transform to the voltage waveform.

9. The droplet jetting apparatus according to claim 1, wherein the voltage information acquirer senses a rising point of the command waveform and acquires the voltage waveform within an information acquiring time period when a set time period passes since a sense timing of the rising point, the information acquiring time period is set to be able to acquire the voltage waveform just after the command waveform has began to fall down.

* * * * *